US007264391B2

(12) United States Patent
Kaandorp

(10) Patent No.: US 7,264,391 B2
(45) Date of Patent: Sep. 4, 2007

(54) SYSTEM AND METHOD FOR FIXING A LAMP IN A REFLECTOR HOUSING

(75) Inventor: Wouter Petrus Kaandorp, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 78 days.

(21) Appl. No.: 10/534,474

(22) PCT Filed: Oct. 21, 2003

(86) PCT No.: PCT/IB03/04692

§ 371 (c)(1),
(2), (4) Date: May 10, 2005

(87) PCT Pub. No.: WO2004/044488

PCT Pub. Date: May 27, 2004

(65) Prior Publication Data

US 2006/0098443 A1 May 11, 2006

(30) Foreign Application Priority Data

Nov. 14, 2002 (EP) ..... 02079741

(51) Int. Cl.
*H01R 33/92* (2006.01)
*F21V 19/14* (2006.01)
*F21V 19/04* (2006.01)

(52) U.S. Cl. ..... 362/649; 362/288; 362/306; 362/440; 362/549

(58) Field of Classification Search ..... 362/649, 362/263, 549, 443, 652, 655, 657, 651, 440, 362/306, 548, 288; 439/332–37, 344
See application file for complete search history.

(56) References Cited

U.S. PATENT DOCUMENTS 4,819,133 A * 4/1989 Kochi et al. ..... 362/519
5,855,430 A * 1/1999 Coushaine et al. ..... 362/519
5,893,632 A * 4/1999 Kusagaya et al. ..... 362/655
6,083,012 A * 7/2000 Suzuki et al. ..... 439/57

* cited by examiner

*Primary Examiner*—Alan Cariaso
*Assistant Examiner*—Leah S. Lovell

(57) ABSTRACT

A lamp fixation system for fixing an electric lamp in a reflector housing in an efficient and effective way. The lamp is positioned in a predetermined position to ensure a reliable electrical power supply. The predetermined position is effected via a cap of the electric lamp which is clamped in a hole in the reflector housing. The cap is provided with spring means for pushing against a surface at the inner wall of the hole in the reflector housing. The spring means comprises a first electrical contact for abutting against an electrical contact in the surface to ensure reliable electric power.

13 Claims, 1 Drawing Sheet

SYSTEM AND METHOD FOR FIXING A LAMP IN A REFLECTOR HOUSING

The invention is related to a lamp fixation system, in particular for automotive use, for fixing an electric lamp in a reflector housing, whereby the cap of the lamp is clamped in a hole in said reflector housing. A reflector housing can be any device in which a lamp can be fixed and which is provided with a more or less light reflecting surface.

A system for fixing a lamp in a reflector housing should provide for an appropriate positioning of the lamp, but another aspect of the system is the constitution of an effective electrical power supply to the lamp. Therefore the cap of the lamp is provided with electrical contacts for contacting corresponding electrical contacts in said reflecting housing or in a separate connection member to be connected to said cap. Each electrical contact of the cap together with a corresponding electrical contact to be connected to it forms a pair of contacts.

There are several systems for fixing a lamp in a reflector housing. A usual system is the bayonet system, whereby the cylindrical surface of the cap of the lamp is provided with two sideward extending pins (protrusions in radial direction). Slots in the cylindrical hole in the reflector housing engage these two pins and the lamp is locked in that position by spring means pushing against the cap in longitudinal (axial) direction, i.e. in the direction of the bulb of the lamp. When mounting the lamp, its cap is pushed into said hole at the reflecting side of said reflector housing. Thereby the cylindrical surface of the cap may form an electrical contact and another electrical contact of the lamp is located at a radial surface at the end of the cap. These contacts cooperate with corresponding contacts in the hole in the reflector housing.

In case the lamp has to be located in an exact predetermined position relative to the reflector housing, other and more complex fixation systems are used, for example in case of a headlamp of a vehicle. Thereby means for positioning of the lamp in the reflector housing and means for supplying the electrical power to the lamp are separated. The electrical power supply to the lamp can be created by connecting a power supply member to the cap before or after the lamp is fixed in the reflector housing. Fixing a lamp in a reflector housing according to such fixation system is rather complicated.

Another possibility is to provide the back side of the reflector housing with electrical contacts for cooperation with electrical contacts at the cap of the lamp. Such contacts can be mutually engaged by turning the lamp around its longitudinal axis. However, such electrical contact means are rather complicated.

An object of the invention is to provide a fixation system for fixing a lamp in a reflector housing in an efficient and effective way, whereby the lamp is positioned in a predetermined position and whereby a reliable electric power supply is ensured.

In order to accomplish that objective, the cap of the lamp is provided with first spring means for pushing against a surface at the inner wall of said hole, whereby said spring means comprise a first electrical contact for abutting against an electrical contact in said surface. Thereby one means provide for two functions, positioning the lamp and supplying electric current to the lamp, resulting in a simpler design (less parts) and/or an easier mounting operation of the lamp.

Said first spring means may comprise a spring member extending outwardly from the cap in radial direction and being able to be pushed inwardly against the force of a spring. Thereby the radial direction is defined relative to the axial direction (longitudinal direction) of the axis of the lamp through the center of the cap and the bulb of the lamp.

The exact positioning of the lamp in radial direction may take place by pushing a cylindrical portion of the cap against two flat surfaces of the inner wall of said hole in the reflector housing, whereby said first spring means provide for the pushing force. The same pushing force ensures a reliable electric contact for electric current supply.

In one preferred embodiment said cap comprises another electrical contact for abutting against another electrical contact in the inner wall of said hole. Thereby said other contact in said inner wall can be a portion of one of said flat surfaces of the inner wall, against which surface the cap is pushed by said first spring means. Preferably, the inner wall of the hole in said reflector housing comprises an elastic movable member that pushes against an appropriate portion of the cap comprising the corresponding electrical contact of the pair of contacts.

In one preferred embodiment the bulb of the lamp and a portion of the cap of the lamp can be moved through said hole from the back side to the reflecting side of said reflector housing, whereby outwardly extending protrusions of said cap pass through slots in the inner wall of said hole, and whereby said protrusions abut against the reflecting side of said reflector housing after the lamp is turned around its longitudinal axis.

Preferably, said cap comprises three of said protrusions, at least two protrusions having different dimensions. Said protrusions, contacting the reflecting side of the reflector housing, provide for the positioning of the lamp in axial direction and by making use of protrusions having different dimensions, the lamp can be fixed in only one position.

In one preferred embodiment said cap is provided with second spring means for pushing against the back side of the reflector housing. Thereby said second spring means can contribute to the positioning of the lamp in axial direction. These second spring means may comprise an electrical contact for abutting against an electrical contact at the back side of the reflector housing, whereby said second spring means incorporate two functions, the axial positioning of the lamp and the reliable supply of electric current to the lamp.

Depending on the type of the lamp—provided with one filament or with two filaments—there are two or three pairs of electrical contacts required to supply the electrical power to the lamp. Apart from one or two of the above-described pairs of electrical contacts, there may be other pairs of contacts to provide for the power supply.

In one preferred embodiment the cap of the lamp comprises a substantial cylindrical grip member extending in longitudinal direction. Such grip member can be engaged by hand and facilitates the mounting of the lamp in the reflector housing.

The invention is also related to a lamp to be fixed by the fixation system as described above, whereby the cap of the lamp is provided with first spring means comprising an electrical contact.

The invention is also related to a reflector housing for use in the fixation system as described above, whereby the reflector housing comprises a hole in which the cap of the lamp can be fixed, and whereby the inner wall of said hole is provided with at least one electrical contact.

Furthermore, the invention relates to a method for fixing an electric lamp in a reflector housing, whereby the cap of the lamp is clamped in a hole in said reflector housing, the cap being provided with first spring means for pushing against a surface at the inner wall of said hole, whereby a first electrical contact in said spring means is placed against an electrical contact in said surface.

The invention will be explained in more detail hereinafter by means of a description of an embodiment of a lamp fixation system, in which reference is made to a drawing, in which.

Figure 1:
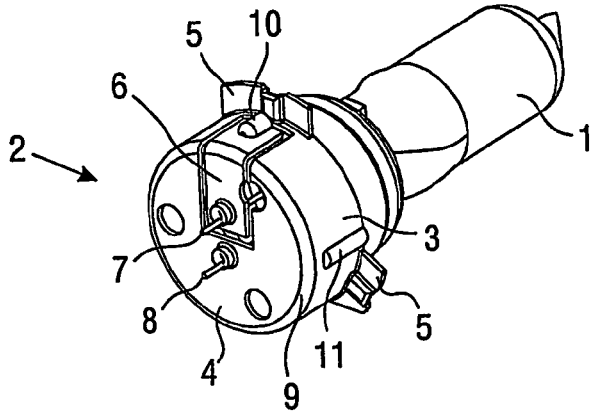
FIG. 1 is a perspective view of a part of an automotive lamp.

FIG. 1 shows the bulb 1 and the cap 2 of an automotive lamp. The cap 2 has a substantial cylindrical surface 3 and a substantial flat surface 4 extending in radial direction. The cylindrical surface 3 is provided with three protrusions 5 extending in radial direction. FIG. 1 shows only two of the three protrusions 5.

The surface of cap 2 of the lamp is made of conductive metal and is divided into two separate portions. The first portion 6 covers a part of the cylindrical surface 3 and a part of the flat surface 4 and the second portion 9 covers the remainder of the relevant surface of the cap 2. Both portions 6,9 are electrical insulated from each other. Each portion 6,9 is welded to one of the two lamp wires 7,8, so that the contact 10 on said first portion 6 and contact 11 on the second portion 9 of the cap surface are two electrical contacts for supplying electric current to the filament in the bulb 1 of the lamp.

First portion 6 is in fact a curved metal strip. The part of first portion 6 covering the flat surface 4 is attached to the cap 2 of the lamp, and the part covering the cylindrical surface 3 is free movable in radial direction. Since the first portion 6 is made from elastic metal, the outwardly extending contact 10 can be pushed inwardly, whereby the first portion 6 function as a spring member providing a radial outwardly directed force.

Figure 2:
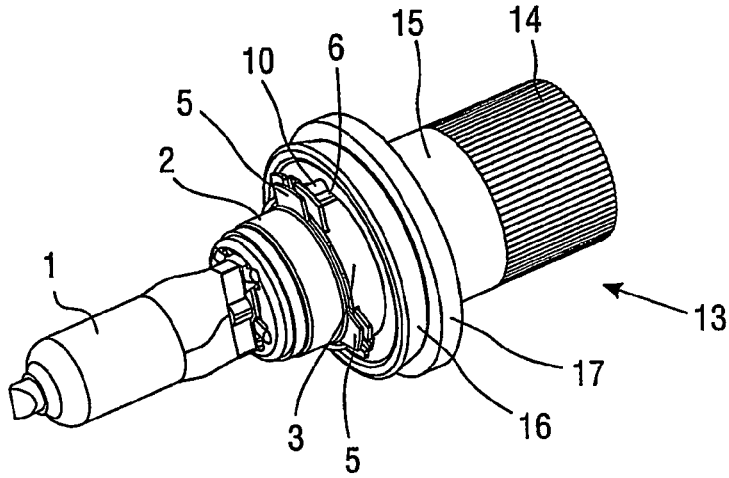
FIG. 2 is another perspective view of the complete lamp.

FIG. 2 shows a complete automotive lamp comprising the bulb 1 and the cap 2 as shown in FIG. 1. A cylindrical grip member 13 is attached against the substantial flat, radial extending surface 4 (see FIG. 1) of the cap 2. The grip member 13 is made of plastic material. When mounting the lamp in the reflector housing, the lamp can be engaged by hand through grip member 13. The cylindrical surface of grip member 13 is provided with a ribbed portion 14, so that the lamp can be easily turned around its longitudinal axis by the fingers of the hand during the mounting operation of the lamp. The cylindrical surface of grip member 13 is also provided with a flat portion 15 and can be engaged by a sealing member in case such sealing member should provide for a watertight sealing.

Furthermore the grip member 13 is provided with a rubber ring 16. Rubber ring 16 is attached to a flange 17 of the grip member 13, and extends in the direction of the bulb 1. When the lamp is fixed in the reflector housing, rubber ring 16 will abut against the back side of the reflector housing. Thereby rubber ring 16 may provide for a watertight sealing against said back side. Furthermore, by deflection of the rubber material there will be exerted an force against said back side, so that the protrusions 5—abutting against the reflecting side of the reflector housing—will be pushed against said reflecting side.

FIG. 2 does not show the other electrical contact 11 (see FIG. 1) of the lamp, because of the position in which the lamp is shown. The same applies for one of the three protrusions 5 in all FIGS. 1, 2 and 3.

Figure 3:
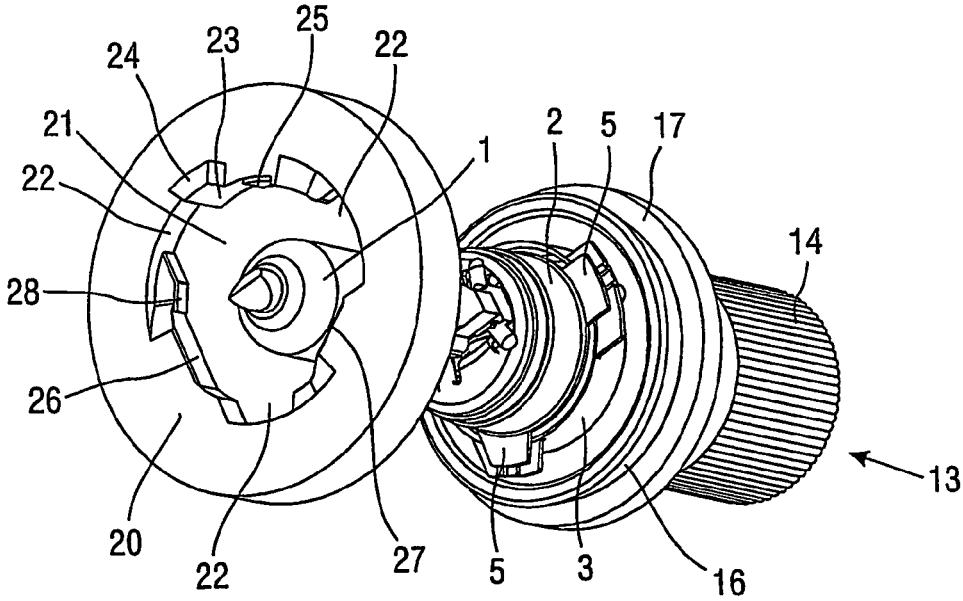
FIG. 3 is a perspective view of the lamp and a portion of the reflector housing.

FIG. 3 shows the same lamp as shown in FIG. 2, and furthermore a disk shaped portion of the reflector housing 20, including the hole 21 in the reflector housing 20. FIG. 3 shows the reflecting side of the reflector housing 20, and when mounting the lamp, the lamp is moved from the back side to the reflecting side of the reflector housing 20 through hole 21, as is shown in FIG. 3. Thereby protrusions 5 pass through slots 22 in the inner wall 23 of hole 21. Because the protrusions 5 have different dimensions, the lamp can be moved through hole 21 in only one position.

After bulb 1 and a portion of cap 2 is passed through hole 21, the lamp is turned around its longitudinal axis, so that protrusions 5 move over the surface at the reflecting side of the reflector housing 20 up to the moment that one of the protrusions 5 reaches stop 24. Then the lamp is fixed in the reflector housing 20. Thereby contact 10 (see FIG. 2) of the lamp is in contact with contact 25 on the inner wall 23 of the hole 21. Because of the force exerted by first portion 6 of the metal cover of the cap 2, the contact 10 will be pushed against contact 25, thereby providing a reliable electrical contact. The cylindrical surface 3 of the cap 2 will be pushed against two flat surfaces 26,27 of the inner wall 23 by the same force, thereby providing for an exact positioning of the lamp relative to the reflector housing 20.

The inner wall 23 of the hole 21 is provided with another electrical contact 28, consisting of a curved metal strip. After the lamp is moved through hole 21 and turned around its longitudinal axis, contact 11 (see FIG. 1) will rest against contact 28. The electrical contact 28 will bend under the pressure of contact 11, providing a reliable electrical contact between the two contacts 11,28.

Of course the reflector housing 20 comprises conductive means to connect the electrical contacts 25, 28 with the source for supplying electric current to the lamp.

An electrical contact member can also be present on the rubber ring 16 (not shown in the figures), whereby the cooperating contact is present on the back side of the reflector housing. Thereby a reliable electrical contact is achieved because of the force of the elastic rubber ring 16 against said back side.

The embodiment of the system as described above is merely an example; a great many other embodiments are possible.

The invention claimed is:

1. A lamp fixation system for fixing an electric lamp in a reflector housing, whereby a cap of the lamp is clamped in a hole in said reflector housing, wherein said cap is divided into a substantially cylindrical surface and a substantial flat surface, wherein a surface of said cap is divided into a first portion and a second portion, said first portion being electrically insulated from said second portion, each of said first and second portions including an electrical contact for supplying electric current to a filament in a bulb of said electric lamp, (i) said first portion covering a part of a cylindrical surface of said cap, freely movable in a radial direction, and said first portion covering a part of a flat portion of said cap, fixedly attached thereto, and (ii) said second portion covering a remainder of a relevant surface of said cap, wherein said first portion is provided with first spring means for providing a radially directed outward force for pushing against a surface at an inner wall of said hole in said reflector housing.

2. A lamp fixation system as claimed in claim 1, wherein said cap comprises another electrical contact for abutting against another electrical contact in the inner wall of said hole.

3. A lamp fixation system as claimed in claim 2, wherein the other electrical contact in the inner wall of said hole comprises an elastic movable member.

4. A lamp fixation system as claimed in claim 1, wherein the bulb of the lamp and a portion of the cap of the lamp can be moved through said hole from the back side to the reflecting side of said reflector housing, whereby outwardly extending protrusions of said cap pass through slots in the inner wall of said hole, and whereby said protrusions abut against the reflecting side of said reflector housing after the lamp is turned about its longitudinal axis.

5. A lamp fixation system as claimed in claim 4, wherein said cap comprises three of said protrusions, at least two protrusions having different dimensions.

6. A lamp fixation system as claimed in claim 1, wherein said cap is provided with second spring means for pushing against the back side of the reflector housing.

7. A lamp fixation system as claimed in claim 6, wherein said second spring means comprise an electrical contact for abutting against an electrical contact at the back side of the reflector housing.

8. A lamp fixation system as claimed in claim 1, wherein the cap of the lamp comprises a substantially cylindrical grip member extending in a longitudinal direction.

9. A lamp to be fixed by the fixation system as claimed in claim 1, wherein the cap of the lamp is provided with first spring means comprising an electrical contact.

10. A reflector housing for use in the fixation system as claimed in claim 1, wherein the reflector housing comprises a hole in which the cap of the lamp can be fixed, and in that the inner wall of said hole is provided with at least one electrical contact.

11. A lamp fixation system as claimed in claim 1, wherein said first portion is a curved metal surface.

12. A lamp fixation system as claimed in claim 1, wherein said flat surface has a diameter of substantially equal dimension to a diameter of said cylindrical surface.

13. A method for fixing an electric lamp in a reflector housing, comprising the steps of:

providing a lamp cap, the lamp cap being divided into a substantially cylindrical surface and a substantial flat surface, a surface of said cap being divided into a first portion and a second portion, said first portion being electrically insulated from said second portion, each of said first and second portions including an electrical contact for supplying electric current to said electric lamp, (i) said first portion covering a part of the cylindrical surface of said cap, freely movable in a radial direction, and said first portion covering a part of a flat portion of said cap, fixedly attached thereto, and (ii) said second portion covering a remainder of a relevant surface of said cap, the first portion being provided with first spring means for providing a radially directed outward force, providing a reflector housing having a hole, and placing a first electrical contact in said spring means against an electrical contact in an inner wall of said hole in said reflector housing.

* * * * *